US006568214B2

(12) United States Patent
Wolff

(10) Patent No.: US 6,568,214 B2
(45) Date of Patent: May 27, 2003

(54) HINGED RING THAT SUPPORTS AN ORNAMENT AND A SYSTEM AND METHOD FOR MAKING SAME

(76) Inventor: Michael Wolff, 80 Rue de Miromesnil, 75 008, Paris (FR)

( * ) Notice: Subject to any disclaimer, the term of this patent is extended or adjusted under 35 U.S.C. 154(b) by 41 days.

(21) Appl. No.: 09/810,296

(22) Filed: Mar. 16, 2001

(65) Prior Publication Data

US 2002/0129619 A1 Sep. 19, 2002

(51) Int. Cl.[7] ..... A44L 17/02
(52) U.S. Cl. ..... 63/29.1; 63/15.7; 63/15
(58) Field of Search ..... 63/15, 26, 29.1, 63/31, 40, 15.7

(56) References Cited

U.S. PATENT DOCUMENTS

| | | | | |
|---|---|---|---|---|
| 253,667 | A | | 2/1882 | Bergfels |
| 2,497,207 | A | | 2/1950 | Burk |
| 2,582,083 | A | | 1/1952 | Tarter et al. |
| 3,566,616 | A | | 3/1971 | Benedict |
| 4,694,664 | A | * | 9/1987 | Elsener ..... 63/12 |
| 4,753,087 | A | | 6/1988 | D'Annunzio |
| 4,763,490 | A | | 8/1988 | Bruner |
| 4,790,148 | A | | 12/1988 | Faini |
| 4,815,180 | A | * | 3/1989 | Elsener ..... 24/616 |
| 4,879,883 | A | | 11/1989 | Bruner |
| 4,991,409 | A | | 2/1991 | Creates |
| 5,133,195 | A | * | 7/1992 | Appelbaum et al. ..... 63/29.1 |
| 5,136,858 | A | | 8/1992 | Bruner |
| 5,349,725 | A | | 9/1994 | Levy |
| 5,651,273 | A | | 7/1997 | Levy |
| 5,816,073 | A | * | 10/1998 | Bardisbanyan ..... 24/616 |
| 6,053,009 | A | | 4/2000 | Broggian |

* cited by examiner

*Primary Examiner*—James R. Brittain
*Assistant Examiner*—Dinesh N Melwani
(74) *Attorney, Agent, or Firm*—Patents+TMS, P.C.

(57) ABSTRACT

An apparatus, a system and a method are provided for a ring having a hinge and shaped to encompass a finger or other member of an individual as well as a system and method for using the apparatus. The apparatus may have two arc sections. Each arc section may have a cavity located at an end of the arc sections. One of the cavities may have a male portion. The apparatus may also have an ornament. The ornament may have a female portion sized to receive the male portion. The male portion and cavities may support the ornament when the ring is in a closed state. One arc section may be positioned towards a second arc section at the hinge.

9 Claims, 1 Drawing Sheet

HINGED RING THAT SUPPORTS AN ORNAMENT AND A SYSTEM AND METHOD FOR MAKING SAME

BACKGROUND OF THE INVENTION

The present invention generally relates to a hinged ring apparatus. More specifically, the present invention relates to an apparatus having a hinge and shaped to encompass a finger or other member of an individual as well as a system and a method for making the apparatus.

It is, of course, generally known to make jewelry. It is also generally known to design rings to fit a member, such as a finger, of a particular size. Rings may be constructed from a number of different materials. Moreover, a number of ornamental designs exist for rings.

Often, an individual may have difficulty placing a ring onto, for example, a finger. The frame of the ring may be rigid and, therefore, may not allow, for example, a finger to pass through the ring opening.

In addition, setting a stone, for example, or other material onto the ring may be a labor-intensive and time-consuming task. Moreover, after the stone is placed onto the ring, the stone may disengage from the ring.

U.S. Pat. No. 6,053,009 to Broggian discloses a ring with an ornament having female portions on opposing sides of the ornament. Male members on arc sections of the ring are receivable within the female portions of the ornament. However, Broggian does not teach a hinge or other means to allow a ring to be positioned around a member and removed without resistance against the member.

U.S. Pat. No. 4,991,409 to Creates discloses a hinged ring having a spring fixed on the hinged end for reaffirming the actions of opening and closing the ring. However, Creates does not teach a male portion which is receivable in a female portion of an ornament to provide support to the ornament and prevent the ornament from disengaging from the ring.

A need, therefore, exists for an apparatus, a system and a method for positioning a ring at a desired location. A need also exists for an apparatus, a system and a method including a ring that may support an ornament and prevent the ornament from disengaging from the ring. Still further, a need exists for an apparatus, a system and a method for a ring that may be assembled without requiring a great amount of time and/or labor.

SUMMARY OF THE INVENTION

The present invention provides an apparatus, a system and a method having a hinge connecting two arc sections shaped to encompass a member. One arc section may have a male portion protruding from an end of the arc section. The male member may be sized to fit inside a female portion which may be inside an ornament. The ornament may be positioned onto the male member and supported by the arc sections. The hinge may allow the apparatus to be positioned around a member and removed with convenience.

To this end, in an embodiment of the present invention, an apparatus is provided having a first arc section having a first end, and a male portion positioned at the first end. A second arc section has a second end. A hinge connects the first arc section and the second arc section.

In an embodiment, an ornament is provided having a female portion sized to receive the male portion.

In an embodiment, a cavity positioned at the first end is sized to receive the ornament.

In an embodiment, the male portion is positioned within the cavity.

In an embodiment, a cavity is positioned at the second end sized to receive the ornament.

In an embodiment, a clasp is provided to prevent movement of the first arc section and the second arc section.

In another embodiment, a system is provided having a first arc section having a first end. A second arc section has a second end, and a male portion extends from the first end. An ornament has a female portion sized to receive the male portion.

In an embodiment, a hinge is provided connecting the first arc section to the second arc section.

In an embodiment, a clasp is positioned on the hinge.

In an embodiment, an ornament has a female portion sized to receive the male portion.

In an embodiment, a cavity positioned at the first end is sized to receive the ornament.

In an embodiment, the male portion extends from the cavity.

In an embodiment, a cavity is positioned at the second end sized to receive the ornament.

In an embodiment, a method is provided for positioning an apparatus around a member. The method comprises the steps of: providing a first arc section having a first end; providing a male portion positioned on the first end; providing a second arc section; providing a hinge connecting the first arc section and the second arc section; and folding the first arc section toward the second arc section.

In an embodiment, a method is provided with an ornament having a female portion sized to receive the male portion.

In an embodiment, a method is provided to position the ornament onto the male portion.

In an embodiment, a method is provided with a clasp to prevent movement of the first arc section and the second arc section.

It is, therefore, an advantage of the present invention to provide an apparatus, a system and a method for a ring that may be positioned at a desired location.

Another advantage of the present invention is to provide an apparatus, a system and a method that may provide a means to secure a stone, for example, or other type of ornament to a ring.

Yet another advantage of the present invention is to provide an apparatus, a system and a method that allows a plurality of ornaments to be secured individually to a ring.

A still further advantage of the present invention is to provide an apparatus, a system and a method that allows removal of the ring from a member without resistance.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a hinged ring apparatus. More specifically, the present invention relates to an apparatus, a system and a method having a hinge and shaped to encompass a finger or other member of an individual. The apparatus may have two arc sections. Each arc section may have a cavity located at an end of the arc section. One of the cavities may have a male portion. The apparatus may also have an ornament. The ornament may have a female portion sized to receive the male portion. The male portion and cavities may support the ornament when the ring is in a closed state. In the closed state, one arc section may be positioned towards a second arc section at the hinge.

Figure 1:
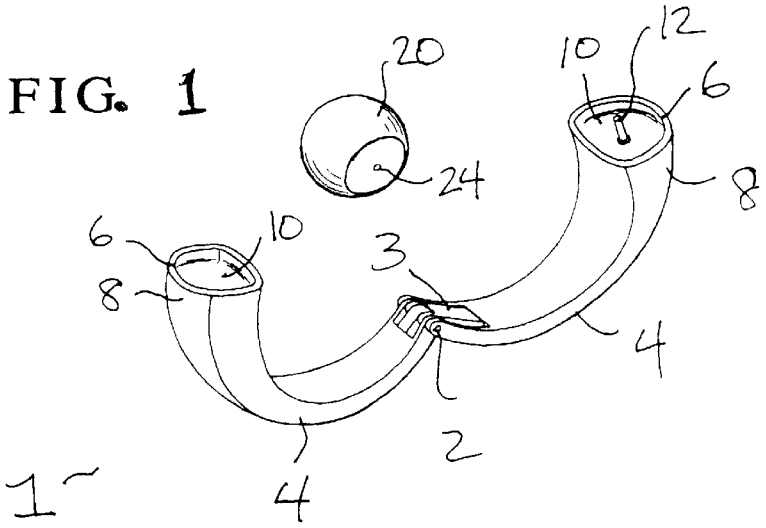
FIG. 1 illustrates a perspective view of an embodiment of the present invention in an open state with an ornament separate from the apparatus.

Referring now to the drawings wherein like numerals refer to like parts, FIG. 1 illustrates a perspective view of an apparatus 1 having a hinge 2. The hinge 2 may have a clasp 3 which may be constructed in a manner similar to clasps created for an earring, a bracelet, or the like. Or, the clasp 3 may be constructed in any other manner known to those skilled in the art. Further, the hinge 2 may be connected to arc sections 4 in any manner known to those skilled in the art. The arc sections 4 may be, preferably, circular in shape. However, the arc sections 4 may also be shaped in any manner known to those skilled in the art. Moreover, the arc sections 4 may be sized to fit around a member, such as, for example, a finger. In addition, the arc sections 4 may be constructed from any material known to those skilled in the art.

The arc sections 4 may have a ridge 6 at an end 8. The ridge 6 may provide support to, for example, a portion of a stone or other material that may be used as an ornament for the apparatus 1. Also, at the end 8 of the arc sections 4 may be a cavity 10. The cavity 10 may be sized to receive and support, for example, a stone or other material that may be used as an ornament for the apparatus 1. Within one cavity 10 of the apparatus 1 may be a male portion 12. The male portion 12 may be attached to or integrally formed with the cavity 10 in a manner known to those skilled in the art. Further, the male portion 12 may be constructed from a material known to those skilled in the art. In addition, the male portion 12 may be sized to fit within an opening in a stone or other material that may be used as an ornament. The apparatus 1 may be constructed using a lost wax process, for example, or in any other manner known to those skilled in the art.

Figure 2:
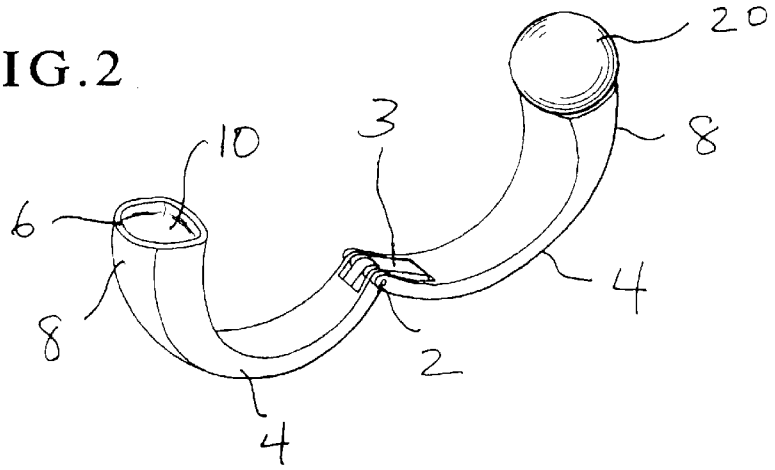
FIG. 2 illustrates a perspective view of an embodiment of the present invention in an open state with an ornament positioned onto the apparatus.

FIG. 2 illustrates the apparatus 1 wherein an ornament 20 may be positioned onto the male portion 12. The ornament 20 may be constructed from any material known to those skilled in the art. Moreover, as illustrated in FIG. 1, the ornament 20 may have a female portion 24 into which the male portion 12 may be positioned when the ornament 20 may be set onto the apparatus 1. The female portion 24 may have an interior that may be constructed to receive the male portion 12 in a manner that may prevent the male portion 12 from disengaging from the female portion 24.

Figure 3:
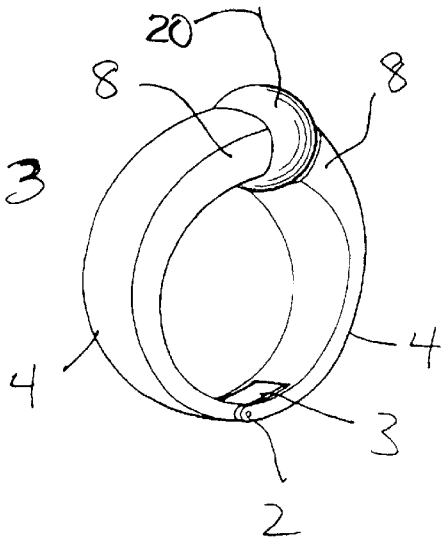
FIG. 3 illustrates a perspective view of an embodiment of the present invention in a closed state.

The apparatus 1 may be positioned, for example, in proximity to a finger of an individual in an open state. The apparatus 1 may then be positioned into a closed state, by positioning the clasp 3 such that the hinge 2 provides resistance from movement. The closed state of the apparatus 1 is illustrated in FIG. 3 with the cavity 10 supporting the ornament 20.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus comprising:

a first arc section having a first end and peripheral walls extending from the first end forming a recessed opening;

a male portion positioned at the first end and extending from the recessed opening;

a second arc section having a second end;

an ornament having a female portion sized to receive the male portion wherein the ornament is positioned within the recessed opening; and a hinge connecting the first arc section and the second arc section.

2. The apparatus of claim 1 further comprising:

a recessed opening within the second end.

3. The apparatus of claim 1 further comprising:

a clasp to prevent movement of the first arc section and the second arc section.

4. A system comprising:

a first arc section having a first end wherein the first end has a cavity defined by a depression extending into the first end;

a male portion extending from the first end within the cavity;

a second arc section having a second end wherein the second end has a cavity defined by a depression extending into the second end;

an ornament secured to the male portion and positioned in the cavity at the first end of the first arc section; and a hinge connecting the first arc section and the second arc section.

5. The system of claim 4 further comprising:

a clasp positioned on the hinge.

6. The system of claim 4 wherein the cavity positioned at the second end is sized to receive the ornament.

7. A method for positioning a ring around a finger, the method comprising the steps of:

providing a first arc section having a first end and peripheral walls extending from the first end forming a recessed opening at the first end;

providing a male portion extending from the first end within the peripheral walls;

providing a second arc section having a cavity;

providing a hinge connecting the first arc section and the second arc section; and folding the first arc section toward the second arc section to secure the ring around the finger.

8. The method of claim 7 further comprising the step of:

positioning the ornament onto the male portion.

9. The method of claim 7 wherein the hinge has a clasp to prevent movement of the first arc section and the second arc section.

* * * * *